United States Patent [19]

Ferrara

[11] Patent Number: 4,974,429

[45] Date of Patent: Dec. 4, 1990

[54] COMBINED BRACELET AND PENDANT

[76] Inventor: Carl J. Ferrara, P.O. Box 591, North Attleboro, Mass. 02761

[21] Appl. No.: 356,702

[22] Filed: May 25, 1989

[51] Int. Cl.[5] ..... A44C 5/00

[52] U.S. Cl. ..... 63/3; 63/29.1

[58] Field of Search ..... 63/29.1, 21, 2, 23, 63/1.1, 5.1, 5.2, 3, 4, 18

[56] References Cited

U.S. PATENT DOCUMENTS

| | | | |
|---|---|---|---|
| 241,453 | 5/1881 | Untermeyer | 63/29.1 |
| D. 247,482 | 3/1978 | Schupp . | |
| 290,590 | 12/1883 | Lettre | 63/2 X |
| 1,382,256 | 6/1921 | Tomchin | 63/29.1 X |
| 1,559,165 | 10/1925 | Hammond . | |
| 1,756,041 | 4/1930 | Vance . | |
| 2,003,950 | 6/1935 | Pejchar . | |
| 2,061,479 | 11/1936 | Philippe . | |
| 3,421,341 | 1/1969 | Hodge | 63/29.1 X |
| 3,983,716 | 10/1976 | Kuhn | 63/1.1 |
| 4,377,939 | 3/1983 | Reinsdorf | 63/23 X |
| 4,393,667 | 7/1983 | Reinstein et al. | 63/29.1 |

*Primary Examiner*—James R. Brittain

*Attorney, Agent, or Firm*—Fleit, Jacobson, Cohn, Price, Holman & Stern

[57] ABSTRACT

A combined bracelet and pendant in which the major ornamental and artistic component forms a part of and is attached to a bracelet in a manner enabling it to be removed and connected to a necklace to form a pendant suspended from the necklace thereby forming an article of jewelry which can be converted from an arrangement forming a bracelet to an arrangement forming a pendant supported from a neck encircling member. The interchangeable major component of the article of jewelry includes a structure which enables it to be connected to a wrist encircling bracelet in a secure and stable manner and also enables it to be connected to a necklace in the form of a flexible member, chain or the like.

6 Claims, 1 Drawing Sheet

COMBINED BRACELET AND PENDANT

BACKGROUND OF THE INVENTION

1. Field of the Invention

The present invention generally relates to an article of jewelry for use as personal adornment in which the major component of the jewelry item can be used in alternative arrangements thereby rendering the article of jewelry more versatile in use. More specifically, the invention relates to a combined bracelet and pendant in which the major ornamental and artistic component forms a part of and is attached to a bracelet in a manner enabling it to be removed and connected to a necklace to form a pendant suspended from the necklace thereby forming an article of jewelry which can be converted from an arrangement forming a bracelet to an arrangement forming a pendant supported from a neck encircling member. The interchangeable major component of the article of jewelry includes a structure which enables it to be connected to a wrist encircling bracelet in a secure and stable manner and also enables it to be connected to a necklace in the form of a flexible member, chain or the like.

2. Information Disclosure Statement

Various articles of jewelry are well known, including bracelets and pendants and it is also known to provide articles of jewelry which can be associated with different components of the human anatomy to render the articles of jewelry more versatile in use. The following U.S. patents are relevant to this type of structure.

Ser. No. D 247,482
U.S. Pat. No. 1,559,156
U.S. Pat. No. 1,756,041
U.S. Pat. No. 2,003,950
U.S. Pat. No. 2,061,479

The above listed patents to not disclose a combined bracelet and pendant constructed in the same manner as this invention.

SUMMARY OF THE INVENTION

An object of the present invention is to provide an article of jewelry in the form of a combined bracelet and pendant in which the major ornamental component includes structure that enables it to be securely fastened to a bracelet in a stable arrangement and yet easily disconnected therefrom and connected with a necklace to support the ornamental component in front of the chest area of a wearer thereby forming a pendant and enabling the ornamental member to be used as a component of a bracelet and as a pendant in a necklace arrangement.

Another object of the invention is to provide a combined bracelet and pendant in which the ornamental member is of rigid construction and provided with a pair of rearwardly projecting, laterally spaced, opposed hooks oriented in facing relation on the rear of the ornamental member for engagement with openings in a split resilient wristband thereby detachably connecting the ornamental member to the wristband to form a bracelet.

A further object of the invention is to provide a combined bracelet and pendant in accordance with the preceding objects in which the ornamental member also includes a rearwardly projecting loop in alignment with one of the hooks and adjacent thereto for engaging a notch structure in the opening in the wristband to stabilize the ornamental member in relation to the wristband with the loop also providing a structure for attachment to a necklace in the form of a neck chain or other flexible member thereby enabling the ornamental member to be used as part of a bracelet or as a pendant support by a necklace.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT

Figure 1:
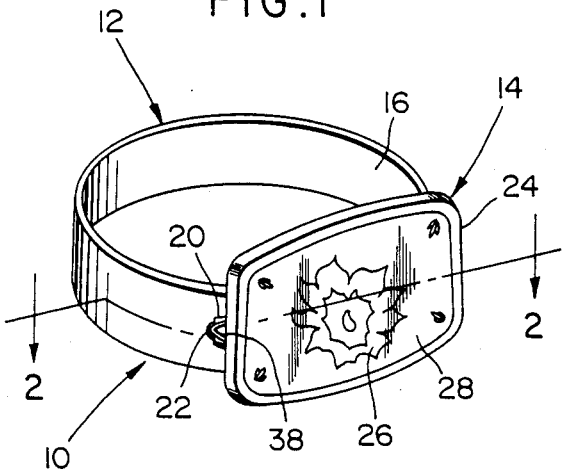
FIG. 1 is a perspective view of the combined bracelet and pendant illustrating the ornamental member associated with a wristband to form a bracelet.
Figure 2:
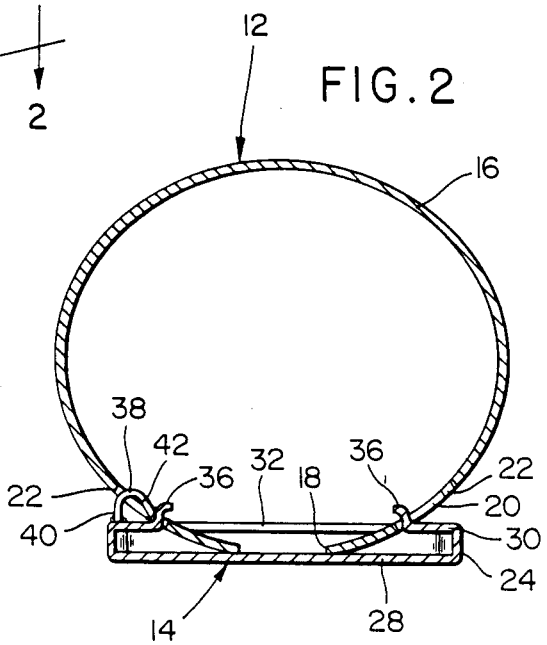
FIG. 2 is a plan, sectional view taken substantially upon a plane passing along section line 2—2 on FIG. 1 illustrating the connection between the split wristband and rigid ornamental member.
Figure 3:
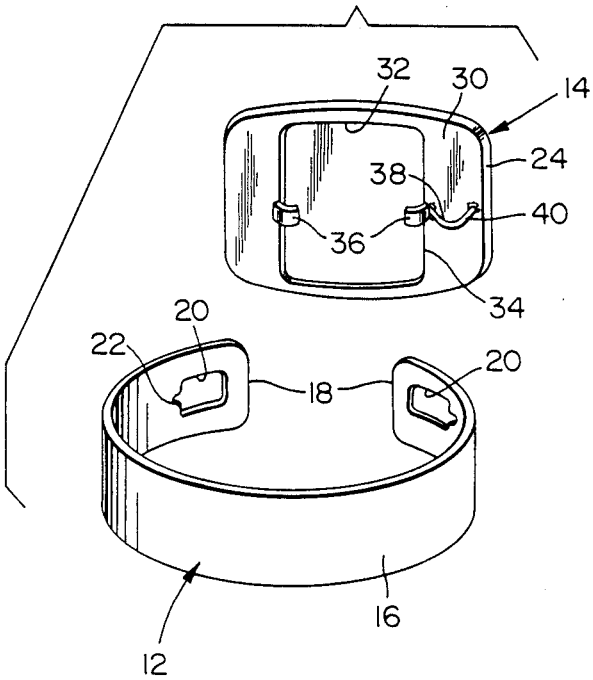
FIG. 3 is an exploded, group perspective view of the wristband and ornamental member forming the bracelet.

Referring now specifically to FIGS. 1–3 of the drawings, a bracelet forming part of the present invention is generally designated by reference numeral 10 and includes a split wristband generally designated by numeral 12 and a rigid ornamental member generally designated by the numeral 14 which are assembled in a manner with the bracelet encircling and mounted on the wrist of the wearer for personal adornment.

The wristband 12 is constructed of resilient material such as metal, plastic or the like and is in the form of an elongated generally circular or oval shaped strap or ring 16 provided with spaced ends 18 to form a split band which can be placed laterally over the wrist or slid longitudinally over the hand onto the wrist with the resiliency of the split ring or strap 16 enabling the ends 18 to move apart during assembly of the wristband onto the wrist with the resiliency of the wristband assuring that it will generally conform with the periphery of the wrist of the wearer. Each end of the strap or ring 16 is provided with a rectangular opening 20 formed therein having its major dimension generally parallel to the top and bottom edges of the ring or strap 16 with the end edges of the opening 20 being perpendicular thereto. The end edge of the openings 20 remote from the end edge 18 of the ring or strap 16 is provided with a centrally disposed notch 22 of generally U-shaped configuration formed therein as illustrated in FIG. 3.

The ornamental member 14 is in the form of a generally rectangular member 24 having rounded corners and top and bottom edges which are also curved. The shape and configuration of the rigid member 24 may vary and may assume any desired configuration having ornamental characteristics such as the ornament 26 incorporated into the outer face of the ornamental member 14 as illustrated in FIG. 1. As illustrated in FIG. 2, the ornamental member 14 includes an outer wall 28 having the indicia 26 incorporated therein and an inner wall 30 having a large opening 32 formed therein with the side edges 34 of the opening 30 being parallel to each other and receiving the ends 18 of the wristband 12 when assembled. Each side edge 34 of the opening 32 includes a rearwardly extending hook 36 which extends rearwardly from the plane of the wall 30 with the hooks 36 disposed in opposed facing relation as illustrated in FIG. 2. Also, as illustrated in FIG. 2, the hooks 36 are received in the openings 20 and engage with the end edges of the openings 20 adjacent the end edges 18 of the wristband 12. Due to the resiliency of the wristband 12, the wristband can be collapsed slightly to engage the opening 20 with the hooks 36 with subsequent release of the wristband enabling it to expand and thus lock the hooks 36 in the openings 20 thereby detachably securing the ornamental member 14 to the wristband 12.

The rear wall 30 of the ornamental member 14 also includes a loop 38 projecting rearwardly therefrom with the loop 38 being disposed in alignment with one of the hooks 36 as illustrated in FIG. 3 with the inner end of the loop 38 being connected to the wall 30 adjacent its juncture with the hook 36 as illustrated in FIGS. 2 and 3 and the outer end of the loop 38 being secured to the wall 30 adjacent the outer edge thereof as illustrated in FIGS. 2 and 3. The loop 38 includes a generally straight outer portion 40 perpendicular to the wall 30 and an inclined inner portion 42 with the juncture between the portions 40 and 42 being curved as illustrated in FIG. 2. Also, the loop 38 projects rearwardly beyond the hook 36 as illustrated in FIG. 2 and is received in and engages the notch 22 in the inner edge of the opening 20 when the hooks 36 are engaged with the openings 20 and the ornamental member 14 is mounted on the wristband 12 with this association of the components being illustrated in FIGS. 1 and 2. This arrangement of components stabilizes the rigid ornamental member 14 in relation to the wristband 12 by providing spaced points of contact between the band and ornamental member provided by the two opposed hooks 36 engaging the inner edges of openings 20 and the loop 38 received in the notch 22 which precludes lateral twisting or rotational movement of the ornamental member in relation to the wristband 12 since the loop 38 engaged in the notch 22 will retain the wristband and ornamental memebr in a stable relationship. The ornamental memebr 14 can still be easily disconnected from and connected to the wristband by squeezing the ends of the wristband towards each other thus disconnecting the wristband from the hook at the end of the wristband that is remote from the interconnection between the loop and notch. After the end of the wristband engaged with the hook 36 remote from the loop 38 is disengaged, then the end of the wristband adjacent the loop 38 can be disconnected from the hook adjacent the loop. The rounded crown portion and downwardly inclined portion 42 of the loop 38 enables the end of the band engaged with the loop to be moved inwardly in relation to the hook with the edge of the notch 22 sliding along the surface of the loop with contact between the edges 18 of the wristband 12 and the inner surface of the outer wall 28 serving to guide and cam the end edges of the wristband as they move laterally and straight inwardly in relation to the hooks 36 and loop 38 thereby enabling either or both ends of the wristband to be sequentially or simultaneously disconnected from the hooks 36.

Figure 4:
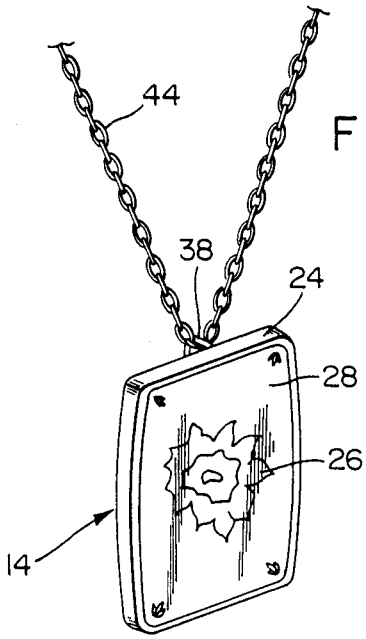
FIG. 4 is a perspective view illustrating the ornamental member associated with a neck chain to form a pendant for a necklace.

FIG. 4 illustrates the ornamental member 14 separated from the wristband 12 and used as a pendant by extending a neck chain 44 or similar flexible necklace or neck encircling member through the loop 38 which will suspend the ornamental member 14 from the neck chain 44 with the ornamentation 26 exposed outwardly for observation. With this construction, the ornamental member may be quickly and easily assembled with repect to the wristband 12 to form a bracelet 10 and just as easily assembled with a neck chain 44 or other neck encircling member to form a pendant thereby enabling the ornamental member to be used both as a component of a bracelet and a component of a necklace with a pendant connected thereto. The ornamental component as well as the wristband and neck chain may be constructed of various materials normally used in constructing articles of jewelry including precious metals with the ornamentation 26 being any desired indicia engraved into a metal surface, stones or other decorative material attached to a surface in any manner or any other type of desired ornamentation or indicia.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A combined bracelet and pendant comprising an ornamental member and means on said ornamental member detachably engageable with a wristband to form a bracelet and a neck encircling member to form a pendant, said ornamental member being of rigid construction and provided with ornamentation on one surface thereof for observation when used as a bracelet and as a pendant, said means on the ornamental member being on the surface thereof opposite to that having said ornamentation, said means engageable with a wristband and neck encircling member including hook means mounted in spaced relation on the ornamental member for engagement with spaced points on a wristband and a loop adjacent one of the hook means for engagement with a neck encircling member, and a split wristband constucted of resilient material having spaced ends, each of said ends including an opening receiving the hook means, at least one of said openings including a notch receiving the loop when the hook means are engaged with the openings to stabilize the ornamental member on the wristband.

2. The structure as defined in claim 1 wherein said hook means are rearwardly extending and inwardly facing in opposed relation with the resiliency of the wristband enabling the ends thereof to be squeezed together to register the openings with the opposed hooks with the resiliency of the wristband retaining the hooks engaged with the openings.

3. The structure as defined in claim 2, wherein said loop is in aligned adjacent relation to one of the hooks, the notch in the opening being centrally disposed in the edge of the opening to receive the loop when the adjacent hook is engaged in the opening thereby stabilizing the wristband and ornamental member in relation to each other.

4. In combination, a split, resilient wristband having spaced ends, an ornamental member, means mounting said ornamental member on the wristband in stable and detachable relation, a neck encircling member, said means mounting the ornamental member on the wristband including means connecting the ornamental member to the neck encircling member when the ornamental member is separated from the wristband thereby forming a bracelet and pendant, said means mounting the ornamental member on the wristband including a pair of spaced anchors on the ornamental member, said spaced anchors being engageable with the wristband when the wristband is reduced in size by squeezing opposed portions to move the spaced ends toward each other, said anchors being securely connected to the wristband in response to the resiliency of the wristband biasing the spaced ends of the wristband toward their original position when the opposite portions of the wristband are released, said spaced anchors on the ornamental member including a pair of inwardly facing, opposed hooks, the spaced ends of said wristband including openings for receiving the opposed hooks when the wristband is reduced in size and securely engaging the hooks when the wristband is released, said means connecting the ornamental member to the neck encircling member including projecting means rigidly mounted on the ornamental member adjacent one of said hooks and engaging the periphery of the opening in opposed, spaced relation to the adjacent hook for stabilizing the ornamental member in relation to the wristband when the projecting means and the adjacent hook engage the opening.

5. In combination, a split, resilient wristband having spaced ends, an ornamental member, means mounting said ornamental member on the wristband in stable and detachable relation, a neck encircling memebr, said means mounting the ornamental member on the wristband including means connecting the ornamental member to the neck encircling member when the ornamental member is separated from the wristband thereby forming a bracelet and pendant, said means mounting the ornamental member on the wristband including a pair of spaced anchors on the ornamental member, said spaced anchors being engageable with the wristband when the wristband is reduced in size by squeezing opposed portions to move the spaced ends toward each other, said anchors being securely connected to the wristband in response to the resiliency of the wristband biasing the spaced ends of the wristband toward their original position when the opposite portions of the wristband are released, said spaced anchors on the ornamental member including a pair of inwardly facing, opposed hooks, the spaced ends of said wristband including openings for receiving the opposed hooks when the wristband is reduced in size and securely engaging the hooks when the wristband is released, at least one of said openings including a notch in the periphery of the opening, said means connecting the ornamental member to the neck encircling member including a loop rigidly mounted on the ornamental member adjacent one of said hooks with the loop engaging the notch in opposed relation to the hook engaging the opening having the notch therein for stabilizing the ornamental member in relation to the wristband when the loop engages the notch and the adjacent hook engages the opening.

6. The combination as defined in claim 5 wherein said ornamental member includes an outer surface having ornamentation thereon and an inner surface spaced from the outer surface, said inner surface including a large opening, said opposed hooks being formed on opposed peripheral portions of the opening in the inner surface, the spaced ends of the wristband being received through the opening in the inner surface when the opposed hooks are engaged with the openings in the spaced ends of the wristband, the opposed portions of the opening in the inner surface of the ornamental member being substantially straight and parallel and the outer surfaces of the wristband adjacent the openings being substantially straight transversely of the wristband for engagement with the parallel edges of the opening in the ornamental member to further stabilize the ornamental member in relation to the wristband.

* * * * *